US007124914B2

(12) United States Patent
Foster et al.

(10) Patent No.: US 7,124,914 B2
(45) Date of Patent: Oct. 24, 2006

(54) DUAL CHAMBER LOTION PUMP

(75) Inventors: Donald D. Foster, St. Charles, MO (US); Philip L. Nelson, Wildwood, MO (US)

(73) Assignee: ContinentalAFA Dispensing Company, Saint Peters, MO (US)

( * ) Notice: Subject to any disclaimer, the term of this patent is extended or adjusted under 35 U.S.C. 154(b) by 584 days.

(21) Appl. No.: 10/338,337

(22) Filed: Jan. 8, 2003

(65) Prior Publication Data

US 2004/0129727 A1 Jul. 8, 2004

(51) Int. Cl.
*B67D 5/052* (2006.01)

(52) U.S. Cl. ..... 222/137; 222/145.5; 222/321.7; 222/383.1

(58) Field of Classification Search ..... 222/136, 222/137, 145.5, 255, 321.7, 372, 383.1
See application file for complete search history.

(56) References Cited

U.S. PATENT DOCUMENTS

| | | | |
|---|---|---|---|
| 3,760,986 | A | 9/1973 | Castner et al. |
| 4,826,048 | A | 5/1989 | Skorka et al. |
| 4,902,281 | A | 2/1990 | Avoy |
| 5,169,029 | A | 12/1992 | Behar et al. |
| 5,339,990 | A | 8/1994 | Wilder |
| 6,082,588 | A | 7/2000 | Markey et al. |

*Primary Examiner*—Kevin Shaver
*Assistant Examiner*—Melvin A. Cartagena
(74) *Attorney, Agent, or Firm*—Thompson Coburn LLP

(57) ABSTRACT

A manually operated vertically reciprocated pump dispenser has a simplified construction with two separate pumps that pump two separate liquids from a container and keep the two separate liquids separated from each other as they are pumped through the dispenser, mixing the liquids for the first time in a discharge passage of the dispenser just prior to the mixed liquids being discharged from the dispenser.

4 Claims, 3 Drawing Sheets

DUAL CHAMBER LOTION PUMP

BACKGROUND OF THE INVENTION (1) Field of the Invention

The present invention pertains to a manually operated dispenser that is connectable to two container volumes containing separate liquids. The dispenser has two separate pump assemblies that draw the separate liquids from the container volumes and then mix the liquids before they are dispensed by the dispenser. The two separate pump assemblies are vertically oriented and are manually vertically reciprocated pump assemblies.

(2) Description of Related Art

Manually operated vertically reciprocated pumps, often referred to as lotion pumps or hand lotion pumps, typically include a pump housing that is attached to the neck of a container containing liquid and a manually operated pump plunger that extends vertically downwardly into the pump housing.

The pump housing includes a pump chamber that is located in the interior of the container of liquid. A dip tube extends downwardly from the pump chamber into the liquid. A one-way valve is positioned between the pump chamber and the dip tube and controls the flow of liquid into the pump chamber from the dip tube, but prevents the reverse flow of liquid. A spring is typically positioned inside the pump chamber.

The pump plunger is tubular and has a liquid discharge passage extending through the plunger from a bottom end to a top end of the plunger. A piston is provided at the plunger bottom end and is positioned inside the pump chamber. A dispenser head having a directional spout is provided on the top of the pump plunger. The spring in the pump chamber engages against the bottom of the plunger and biases the plunger and piston upwardly. A second one-way valve is typically located in the pump plunger discharge passage adjacent the piston. The second valve permits the flow of liquid from the pump chamber upwardly through the pump plunger to the dispenser head at the top of the pump plunger, but prevents the reverse flow of liquid.

By manually pressing the pump plunger downwardly into the pump housing, the piston moves downwardly through the pump chamber and compresses the fluid (air) in the pump chamber. This causes the first one-way valve to close and the second one-way valve to open. The fluid in the pump chamber moves upwardly past the second one-way valve and through the plunger and is dispensed from the dispenser head at the top of the plunger. Releasing the plunger allows the spring in the pump chamber to push the plunger upwardly relative to the pump housing. This moves the piston upwardly through the pump chamber and creates a vacuum in the pump chamber. The vacuum causes the second one-way valve to close and the first one-way valve to open, drawing liquid from the container into the pump chamber. On subsequent manual downward and upward manipulation of the pump plunger relative to the pump housing the liquid drawn into the pump chamber is dispensed from the dispenser head.

The above described vertically reciprocating pump has been employed in the past in dispensing various different types of liquids from the containers to which the pumps are attached. However, the conventional vertically reciprocating pump dispenser has drawbacks when employed with certain types of liquids.

Certain liquids dispensed from conventional vertically reciprocated pump dispensers are the product of two or more separate liquid components that remain stable while separated but have a limited shelf life when they are mixed together. Reciprocating pump dispensers that are attached to containers containing liquids of this type cannot remain in storage or on a store shelf for a prolonged period of time before the liquid product begins to lose its effectiveness. To employ the conventional vertically reciprocating pump dispenser for dispensing liquids of this type and to ensure that the shelf life of the liquid product does not expire before the product is sold, the separate liquid components of the final liquid product must be mixed together to produce the final liquid product just prior to the liquid product being packaged in the containers and shipped to the market where they are offered for sale.

In addition, some liquid products are comprised of one or more component liquids that do not readily mix with each other, for example, a water based component and oil. When liquid products of this type are packaged in containers with vertically reciprocating pump dispensers, the separate liquid components that make up the final product tend to separate from each other while the product is stored in inventory or while the product sits on a store shelf awaiting sale. In use of a conventional vertically reciprocating pump dispenser with a container containing a product of this type, after the component liquids of the final product are separated out, operation of the pump dispenser would result in dispensing only that liquid component that had settled to the bottom of the container. In the oil and water based component example, only the water based component of the liquid would be dispensed initially from the pump dispenser. Once all the water based component has been dispensed, then only the oil would be dispensed from the pump dispenser.

SUMMARY OF THE INVENTION

The manually operated, vertically reciprocated pump dispenser of the invention overcomes the disadvantages associated with prior art dispensers employed in dispensing liquids comprised of at least two separate component liquids. The vertically reciprocated pump dispenser of the invention keeps the two component liquids separate from each other until they are mixed together for the first time in the discharge passage of the pump dispenser just prior to their being dispensed from the dispenser. Thus, the problems of expired shelf life and/or separation of liquid components in the container are avoided.

The manually operated, vertically reciprocated pump dispenser of the invention is designed to be attached to a container containing two separate liquid components. The pump dispenser of the invention may be connected to two separate containers containing the two separate liquid components, or alternatively may be connected to a single liquid container having a partition in its interior dividing the container into two separate container volumes containing the separate liquid components.

The dispenser of the invention is basically comprised of a pump housing and a plunger housing that is mounted in the pump housing for manual, vertical reciprocating movement of the plunger housing in the pump housing. In the preferred embodiment the component parts of the dispenser are constructed of resilient plastic materials except for a metal coil spring that biases the pump plunger away from the pump housing.

The pump housing is constructed with a connector cap that attaches the dispenser to the neck of a container containing the two liquid components to be dispensed by the dispenser. The connector cap attached to the container neck orients the dispenser uprightly or vertically relative to the container with the container also positioned in an upright or vertical orientation. The pump housing has a pair of separate pump chambers that extend monolithically from the connector cap downwardly into the container. A pair of dip tubes extend downwardly from the two separate pump chambers and into the two separate liquids. The pump housing positions the two pump chambers side by side which in turn positions the two dip tubes side by side.

Pump chamber one-way valves are positioned in each pump chamber separating the interior volume of the pump chamber from the dip tubes. The pump chamber one-way valves permit the flow of liquid upwardly through the dip tubes into the pump chambers, but prevent the reverse flow of liquid from the pump chambers downwardly through the dip tubes.

The pump plunger has two side by side piston rods that extend downwardly into the two pump chambers of the pump housing. Two pump pistons are mounted on the bottom ends of the two piston rods. Each piston is mounted in one of the pump chambers for downward and upward reciprocating movement of the piston in the pump chamber in response to downward and upward reciprocating movement of the two piston rods. The piston rods are hollow and their interiors function as two rod liquid passages extending upwardly from the two pump chambers. The coil spring is positioned between the two piston rods and the pump housing and biases the two piston rods away from the pump housing.

Piston rod one-way valves are positioned inside the rod passages at the bottoms of the rods. The piston rod one-way valves permit the flow of liquid upwardly through the piston rod passages from the two pump chambers, but prevent the reverse flow of liquid from the two piston rod passages to the two pump chambers.

A manifold connects the top ends of the two piston rods together. The manifold has a manifold chamber that communicates with the interior rod passage of each of the two piston rods.

A dispenser head is connected to the manifold. The dispenser head has an internal discharge passage that communicates with the manifold chamber.

A cylindrical sleeve is attached to the top of the pump housing and extends around the two piston rods of the pump plunger. The sleeve is provided to give the pump plunger an aesthetically pleasing appearance.

The dispenser head has an exterior cover that extends around the top of the sleeve surrounding the pump plunger. The cover is also provided to give the plunger an aesthetically pleasing appearance.

In operation of the manually operated, vertically reciprocated pump dispenser of the invention, pressing the dispenser head downwardly causes the two piston rods and their two pistons to move downwardly through the interiors of the two pump chambers. This compresses the fluid (air) in the pump chambers which causes the two pump chamber one-way valves to seat and the two piston rod one-way valves to open. The fluid compressed in the pump chambers travels upwardly through the rod passages, through the manifold and to the discharge passage and is dispensed from the dispenser.

On releasing the dispenser head, the spring of the dispenser pushes the pump plunger away from the pump housing. This causes the piston rods to move upwardly in the pump chambers causing the piston rod one-way valves to seat and creating vacuums in the pump chambers. The vacuums cause the pump chamber one-way valves to unseat. This draws the two separate liquids upwardly through the two separate dip tubes and into the two separate pump chambers.

On subsequent manually downwardly pressing the dispenser head, the two piston rods and their pistons again move downwardly through the two pump chambers. This causes the two separate liquids in the two pump chambers to seat the pump chamber one-way valves and unseat the piston rod one-way valves. The two liquids in the two pump chambers are pumped upwardly through the two piston rod passages through the manifold and to the discharge passage in the dispenser head where the two separate liquids are mixed. The mixed liquid is then dispensed from the dispenser head through the discharged passage.

Subsequent manually depressing the dispenser head downwardly and releasing the dispenser head so that the spring moves the plunger upwardly continues to pump the two separate liquids through the dispenser and mixes the two separate liquids just before they are discharged from the dispenser head.

The manually vertically reciprocated pump dispenser of the invention described above provides a simplified construction of a pump dispenser that can draw two separate liquids from a liquid container and keep the two separate liquids separated from each other as they are pumped through the dispenser until they are mixed for the first time just prior to their being dispensed from the dispenser.

BRIEF DESCRIPTIONS OF THE DRAWING FIGURES

Further features of the invention are revealed in the following detailed description of the preferred embodiment of the invention and in the drawing figures wherein.

DETAILED DESCRIPTION OF THE PREFERRED EMBODIMENT

Figure 1:
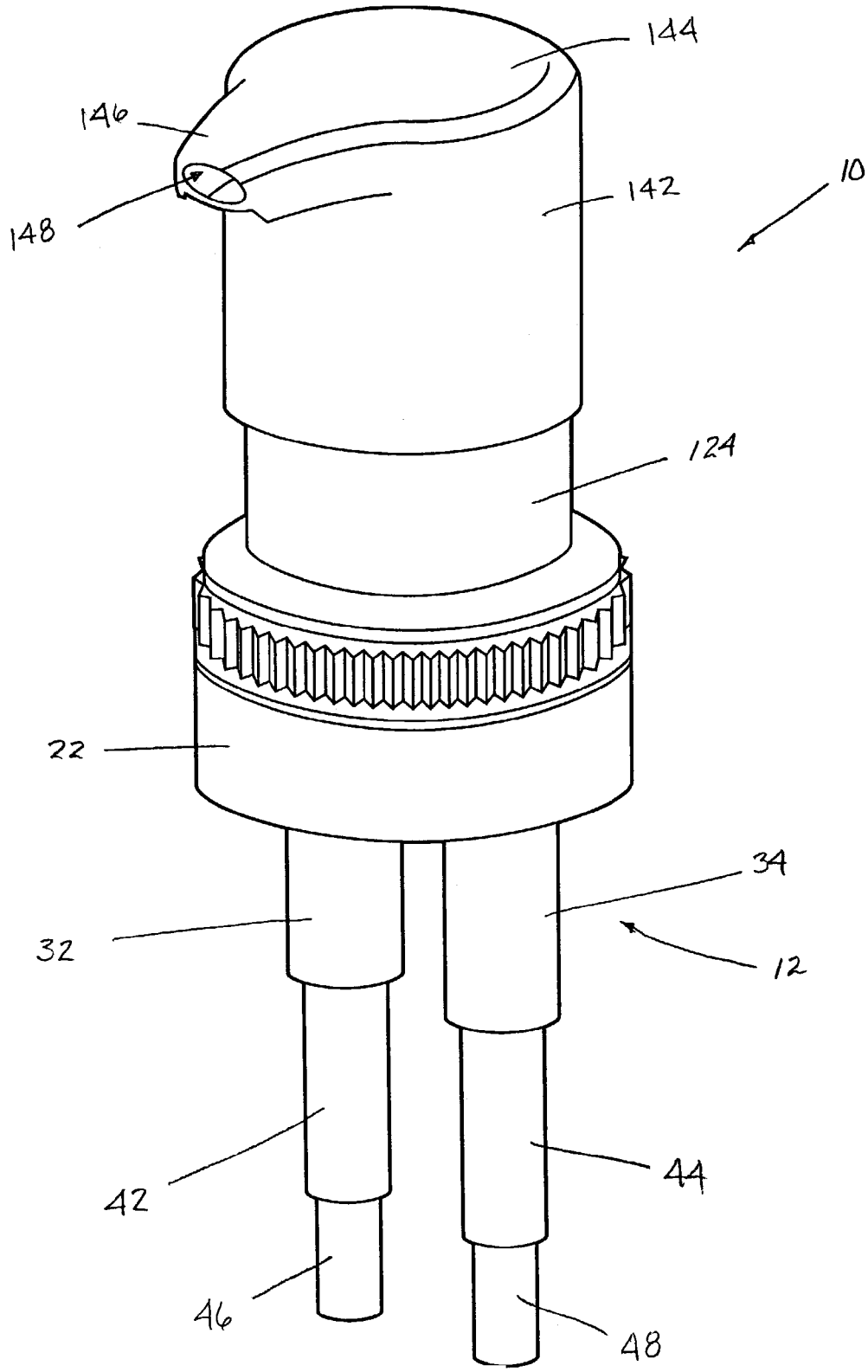
FIG. 1 is a perspective elevation view of the dual chamber lotion pump of the present invention.
Figure 2:
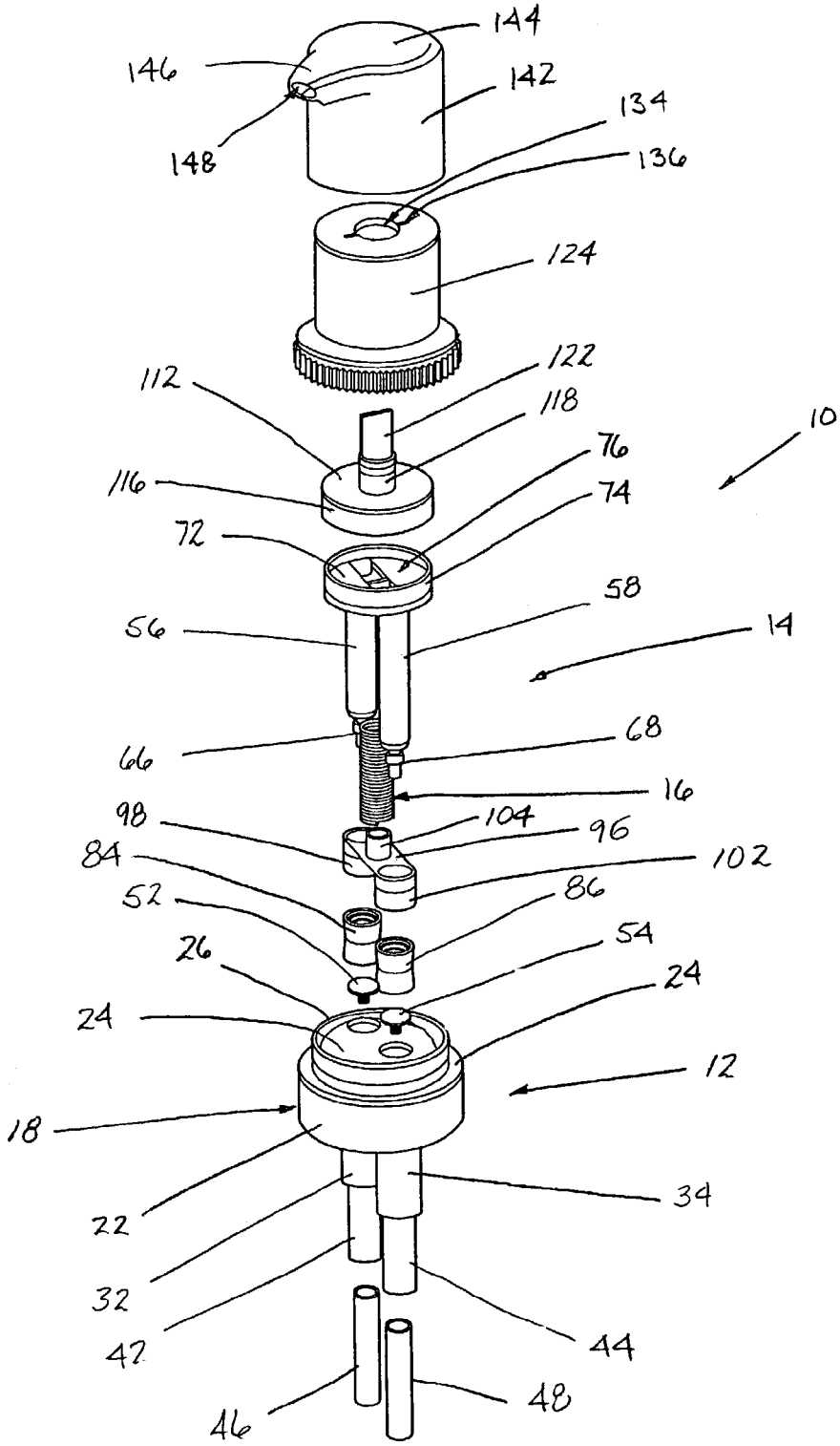
FIG. 2 is an exploded view of the component parts of the dual chamber pump of FIG. 1.
Figure 3:
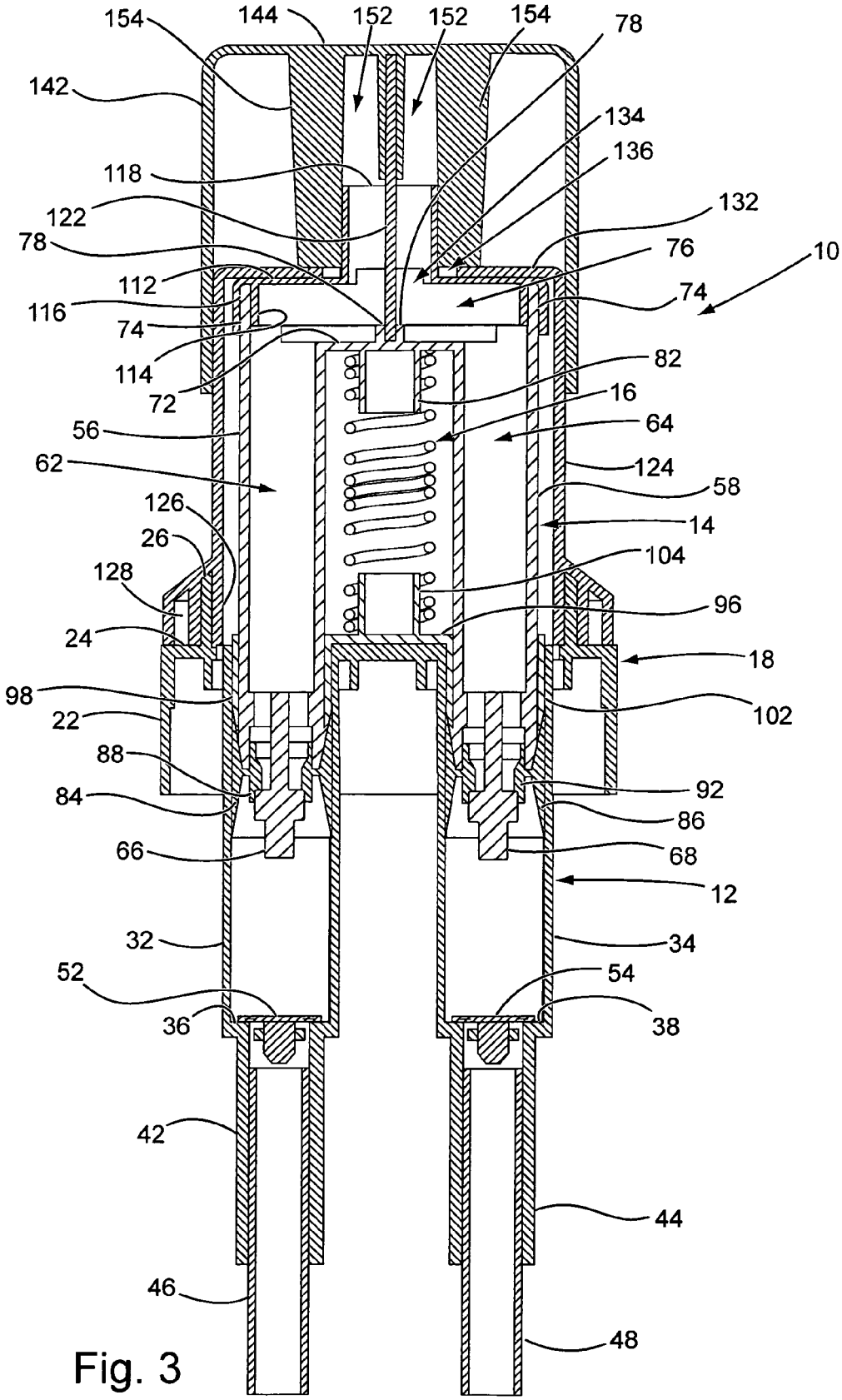
FIG. 3 is a cross-section elevation view of the dual chamber pump.

As stated earlier, the manually operated, vertically reciprocated pump dispenser of the invention is designed to be attached to a container containing two separate liquid components. The pump dispenser of the invention may be connected to two separate containers containing the two separate liquid components. Alternatively, the pump dispenser of the invention may be connected to a single liquid container having a partition in the interior of the container that divides the interior into two separate container volumes containing the separate liquid components.

The dispenser 10 of the invention is basically comprised of a pump housing 12 and a plunger housing 14 that is mounted in the pump housing for manual, vertical reciprocating movement of the plunger housing 14 in the pump housing 12. In the preferred embodiment of the dispenser, the component parts of the dispenser are constructed of resilient plastic materials except for a metal coil spring 16 that biases the pump plunger 14 away from the pump housing 12.

The pump housing 12 is constructed with a connector cap 18. The cap has a cylindrical side wall 22 with an interior surface that is configured to attach the cap 18 to the neck of a container (not shown) containing the two liquid components to be dispensed by the dispenser. The interior of the cap side wall 22 could be provided with a threaded type connection or a bayonet type connection. The cap has a circular top wall 24 that extends across the top of the side wall 22. A cylindrical mounting wall 26 projects upwardly from the cap top wall 24. A first cylindrical pump chamber 32 and a second cylindrical pump chamber 34 extend downwardly from the cap top wall 24. The connector cap 18, the first pump chamber 32, and the second pump chamber 34 are all connected together as one monolithic piece. Each pump chamber 32, 34 has a hollow interior volume and opens through the cap top wall 24. Each of the pump chambers has a circular bottom wall 36, 38 and a tubular dip tube connector 42, 44 that projects downwardly from the bottom wall. The pump housing positions the two pump chambers 32, 34 and their dip tube connectors 42, 44 in parallel, side-by-side positions.

First and second dip tubes 46, 48 are inserted into the dip tube connectors 42, 44 and extend downwardly from the connectors. When the dispenser 10 is attached to the liquid container (not shown), the side by side positioning of the dip tubes 46, 48 will enable each dip tube to be inserted into the liquid of the separate interior volumes of the container.

First 52 and second 54 pump chamber one-way valves are mounted in the circular bottom walls 36, 38 of each pump chamber 32, 34. The one-way valves 52, 54 are disk type one-way valves that are known in the art. The one-way valves separate the interior volumes of the two pump chambers 32, 34 from their respective dip tubes 46, 48. The pump chamber one-way valves 52, 54 permit the flow of liquid upwardly through the dip tubes 46, 48 and into the pump chambers 32, 34, and prevent the reverse flow of liquid from the pump chambers downwardly through the dip tubes.

The pump plunger housing 14 has first 56 and second 58 cylindrical piston rods that are positioned side by side and extend downwardly into the two respective pump chambers 32, 34. The piston rods 56, 58 are hollow along their entire lengths and have interior bores that define a first rod passage 62 and a second rod passage 64 through the respective piston rods 56, 58. The piston rods 56, 58 are open at their bottom ends so that the first and second rod passages 62, 64 communicate with the interior volumes of the first and second pump chambers 32, 34. Each of the piston rods 56, 58 has a center plug 66, 68 at the bottom end of the rod positioned in the center of the rod passages 62, 64. A manifold chamber defined by a circular bottom wall 72 and a cylindrical side wall 74 interconnects the two piston rods 56, 58 in their side by side parallel positions. The piston rods 56, 58 open through the manifold bottom wall 72 so that the first and second rod passages 62, 64 communicate with an interior volume 76 of the manifold. A pair of spaced ridges 78 project upwardly from the manifold bottom wall 72 and extend parallel to each other completely across the manifold bottom wall 72 to opposite sides of the manifold side wall 74. A spring positioning tube 82 projects downwardly from the manifold bottom wall 72 at the center of the bottom wall.

A first piston 84 and a second piston 86 are mounted to the bottom ends of the respective first piston rod 56 and second piston rod 58. The first piston 84 has an integral first rod one-way valve 88 and the second piston 86 has an integral second rod one-way valve 92. The constructions of the pistons and their integral one-way valves are known in the art. The first and second pistons 84, 86 are cylindrical and extend around the bottom ends of the first and second piston rods 56, 58. The pistons 84, 88 engage in a sliding sealing engagement with the interior surfaces of the first and second pump chambers 32, 34. The first and second rod one-way valves 88, 92 also have a cylindrical configuration and are mounted in the interiors of the first and second piston rods 56, 58 at the lower ends of the rods. Portions of the first and second one-way valves 88, 92 engage in a sliding sealing engagement against the interior surfaces of the first and second piston rods 56, 58. Lower portions of the first and second one-way valves 88, 92 engage in a sliding sealing engagement around the center plugs 66, 68 of the first and second piston rods 56, 58. The mounting of the first and second pistons 84, 86 and their integral one-way valves 88, 92 on the first and second piston rods 56, 58 enables the pistons and valves to move to a limited extent upwardly and downwardly relative to the piston rods. When the pistons 84, 86 and their valves 88, 82 move upwardly relative to the piston rods 56, 58 the one-way valves 88, 92 disengage from the rod center plugs 66, 68 opening communication between the interior volumes of the pump chambers 32, 34 and the first and second rod interior passages 62, 64. When the pistons 84, 86 and their integral one-way valves 88, 92 move downwardly relative to the piston rods 56, 58 the valves 88, 92 move over the piston rod center plugs 66, 68 closing communication between the interior volumes of the first and second pump chambers 32, 34 and the first and second rod passages 62, 64.

A piston stop having a circular base 96 is mounted on the cap top wall 24. The piston stop has first 102 and second 104 cylindrical tubular collars that extend downwardly from the piston stop base 96 into the respective first 32 and second 34 pump chambers. The collars 98, 102 have hollow interior bores that receive the respective first and second piston rods 56, 58 for sliding reciprocating movement of the rods through the collars. The collars 98, 102 are dimensioned smaller than the first and second pistons 84, 86 preventing the pistons from moving past the collars in the pump chambers 32, 34. Thus, the collars 94, 102 limit the upward movement of the first and second pistons 84, 86 in the first and second pump chambers 32, 34. The piston stop base 96 has a spring positioning tube 104 positioned on its top surface directly below the spring positioning tube 82 of the manifold.

The metal coil spring 16 is positioned between the pump housing 12 and the plunger housing 14. The spring 16 is positioned with opposite ends of the spring overlapping the manifold spring positioning tube 82 and the piston stop positioning tube 104. The spring 16 biases the plunger housing 14 away from the pump housing 12.

A manifold cover having a circular top wall 112 is mounted on the cylindrical manifold side wall 74 of the plunger housing 14. An inner cylindrical side wall 114 and outer cylindrical side wall 116 extend downwardly from the peripheral edge of the manifold cover top wall 112 over the respective interior and exterior surfaces of the cylindrical manifold side wall 74 of the plunger housing 14. A center cylindrical discharge tube 118 projects upwardly from the manifold cover top wall 112. A divider wall 122 extends across the center of the discharge tube 118 dividing the interior bore of the tube into two separate passages. The bottom end of the divider wall 122 engages between the pair of ridges 78 in the manifold bottom wall 72. The divider wall 122 extends upwardly to a top end of the divider wall that is positioned outside of the bore of the manifold discharge tube 118.

A cylindrical sleeve 124 is mounted on the cap 18 around the plunger housing 14. A locked ring at the bottom end of the sleeve comprises a cylindrical interior wall 126 and a cylindrical exterior wall 128 that engage in sliding contact with opposite sides of the cap mounting wall 26 mounting the sleeve 124 for rotation on the cap 18. The cylindrical sleeve 124 completely encloses the plunger housing 14 giving the dispenser 10 an aesthetically pleasing appearance. The sleeve has a circular top wall 132 with a center opening 134 through which the manifold discharge tube 118 extends. A pair of slots 136 in the sleeve top wall 132 project radially outwardly from opposite sides of the top wall opening 134.

A dispenser head having a cylindrical side wall 142 is mounted on the top of the cylindrical sleeve 124. The dispenser head side wall 142 is dimensioned slightly larger than the cylindrical sleeve 124 enabling the dispenser head side wall 142 to slide and reciprocate over the exterior surface of the cylindrical sleeve 124. The dispenser head has a top wall 144 and a tubular spout 142 with an interior bore 148 that project radially outwardly from the dispenser head side wall 142. Together the dispenser head side wall 142, top wall 144, and spout 146 form a cover over the top of the cylindrical sleeve 124 that together with the cylindrical sleeve gives the dispenser 10 and aesthetically pleasing appearance. The spout interior bore 148 communicates with a cylindrical discharge passage 152 in the center of the dispenser head. The manifold discharge tube 118 is inserted into the dispenser head discharge passage 152 communicating the interior volume 76 of the manifold with the dispenser head discharge passage 152 and the spout interior bore 148. The manifold divider wall 122 extends upwardly through the dispenser head discharge passage 152. A pair of parallel panels 154 extend downwardly from the dispenser head top wall 144 on opposite sides of the manifold divider wall 122. Together, the dispenser head panels 154 and the manifold divider wall 122 divide the dispenser head discharge passage 152 into two separate passages that do not merge with each other or communicate with each other until they enter the spout interior bore 148. A pair of locking walls 156 project radially outwardly from opposite sides of the dispenser head discharge passage 152. The locking walls 156 extend radially outwardly beyond the peripheral dimension of the cylindrical sleeve top wall opening 134, but not beyond the dimensions of the top wall opening slots 136.

In operation of the manually operated, vertically reciprocated pump dispenser 10 of the invention, the cylindrical sleeve 124 is first rotated to an unlocked position of the sleeve 124 relative to the cap 18. The sleeve outer wall 128 and the cap side wall 22 are provided with indicia indicating when the sleeve 124 is in the unlocked position relative to the cap 18. In this position of the sleeve the sleeve top wall opening slots 136 are aligned with the dispenser head panels 154 enabling the panels to slide upwardly and downwardly through the slots. Rotating the sleeve 124 away from the unlocked position misaligns the dispenser head panels 154 with the sleeve top wall opening slots 136 preventing the dispenser head from being reciprocated relative to the sleeve.

With the sleeve 124 moved to the unlock position, the dispenser head is manually pushed downwardly causing the two piston rods 56, 58 and their respective pistons 84, 86 to move downwardly through the interiors of the two pump chambers 32, 24. This compresses the fluid in the pump chambers which causes the two pump chamber one-way valves 52, 54 to seat and the two piston rod one-way valves 88, 92 to open. The fluid compressed in the pump chambers 32, 34 travels upwardly past the piston rod one-way valves 88, 92 and through the first and second piston rod passages 62, 64 and the manifold interior volume 76 to the dispenser head spout interior bore 138 and is dispensed from the dispenser.

On releasing the dispenser head, the spring 16 pushes the pump plunger 14 upwardly away from the pump housing 12. The causes the first and second piston rods 56, 58 to move upwardly relative to the pump housing 12. The upward movement of the piston rods 56, 58 causes the respective first and second pistons 84, 86 and first and second rod one-way valves 88, 92 to move downwardly relative to the piston rods 56, 58 closing the one-way valves. The first and second pistons 84, 86 then move upwardly with the first and second piston rods 56, 58 through the first and second pump chambers 32, 34 creating a vacuum in each of the chambers. The vacuums in the pump chambers 32, 34 cause the pump chamber one-way valves 52, 54 to unseat and draws the two separate liquids upwardly through the first and second dip tubes 46, 48 into the respective first and second pump chambers 32, 34.

On subsequent manually downwardly pressing the dispenser head, the two piston rods 62, 64 again move downwardly through the pump chambers 32, 34. This causes the first and second pistons 84, 86 and their associated one-way valves 88, 92 to move upwardly relative to the piston rods 56, 58 opening communication between the first and second pump chambers 32, 34 and the respective first and second rod passages 62, 64. The downward movement of the first and second pistons 84, 86 through the first and second pump chambers 32, 34 into the two separate liquids contained in the pump chambers causes the pump chamber one-way valves 52, 54 to seat. The two liquids in the two pump chambers 32, 34 are pumped upwardly past the unseated first and second rod one-way valves 88, 82 and through the first and second rod passages 62, 64, through the manifold interior volume 76 and into the dispenser head spout interior bore 148 where the two liquids are mixed. The mixed liquid is then dispensed from the dispenser spout 146.

Subsequent releasing the dispenser head so that the spring 16 pushes the plunger housing 14 upwardly and manually depressing the dispenser head and plunger housing 14 downwardly continues to pump the two separate liquids through the dispenser 10 and mixes the two separate liquids just before they are discharged from the dispenser head.

The manually vertically reciprocated pump dispenser of the invention described above provides a simplified construction of a pump dispenser that can draw two separate liquids from a liquid container and keep the two separate liquids separated from each other as they are pumped through the dispenser until they are mixed for the first time just prior their being dispensed from the dispenser.

Although the dual chamber pump dispenser of the invention has been described above by reference to a specific embodiment, it should be understood that modifications and variations of the dispenser may be constructed without departing from the scope of the invention defined in the following claims.

What is claimed is:

1. A dual liquid dispenser comprising:

a first pump chamber;

a second pump chamber;

a first piston mounted in the first pump chamber for reciprocating movement of the first piston in the first pump chamber;

a second piston mounted in the second pump chamber for reciprocating movement of the second piston in the second pump chamber;

a first piston rod with a first rod passage extending through the first piston rod, the first piston being on the first piston rod;

a second piston rod with a second rod passage extending through the second piston rod, the second piston being on the second piston rod;

a manifold interconnecting the first piston rod and the second piston rod as one monolithic piece;

the manifold having a bottom wall that interconnects the first piston rod and the second piston rod, the first and second piston rods opening through the manifold bottom wall communicating the first and second rod passages with an interior volume of the manifold; and, the manifold having a side wall that extends upwardly from and around the manifold bottom wall.

2. The dispenser of claim 1, further comprising:

a manifold cover mounted on the manifold side wall enclosing the manifold interior volume.

3. The dispenser of claim 2, further comprising: a discharge tube projecting upwardly from the manifold cover.

4. A dual liquid dispenser comprising:

a first pump chamber;

a second pump chamber;

a first piston mounted in the first pump chamber for reciprocating movement of the first piston in the first pump chamber;

a second piston mounted in the second pump chamber for reciprocating movement of the second piston in the second pump chamber;

a first piston rod with a first rod passage extending through the first piston rod, the first piston being on the first piston rod;

a second piston rod with a second rod passage extending through the second piston rod, the second piston being on the second piston rod;

a manifold interconnecting the first piston rod and the second piston rod as one monolithic piece;

a pump housing containing the first and second pump chambers;

a connector cap on the pump housing, the connector cap being configured to attach the pump housing to a separate container;

the first and second pump chambers extending downwardly below the cap;

portions of the first and second piston rods extending into the connector cap;

portions of the first and second piston rods extending upwardly above the connector cap; and, a cylindrical sleeve mounted on the connector cap surrounding the portions of the first and second piston rods extending upwardly above the cap.

* * * * *